United States Patent [19]

Rokita

[11] Patent Number: 4,658,457

[45] Date of Patent: Apr. 21, 1987

[54] COMBINATION FASTENER REMOVER AND DIMPLER

[75] Inventor: Stephen Rokita, Sussex, N.J.

[73] Assignee: R.J. Tool Design, Inc., Hoboken, N.J.

[21] Appl. No.: 852,722

[22] Filed: Apr. 14, 1986

[51] Int. Cl.[4] ..... B25F 1/00

[52] U.S. Cl. ..... 7/170; 7/105; 15/235.3; 254/18

[58] Field of Search ..... 7/105, 170; 15/235.3; D8/45, 47, 89; 81/44; 254/25, 18, 21

[56] References Cited

U.S. PATENT DOCUMENTS

| | | | |
|---|---|---|---|
| 1,189,090 | 6/1916 | Gelinski | 254/25 |
| 2,094,459 | 9/1937 | Lipson | 254/18 |
| 2,533,112 | 12/1950 | Hayden | 254/18 |
| 2,783,799 | 5/1957 | Hart | 81/44 |
| 3,218,030 | 11/1965 | Baro | 254/18 |
| 3,228,269 | 1/1966 | Heyer | 81/124.2 |
| 3,964,854 | 6/1976 | Groeneveld | D8/45 |
| 4,041,558 | 8/1977 | Victor | D8/47 |

*Primary Examiner*—Roscoe V. Parker
*Attorney, Agent, or Firm*—Siegmar Silber

[57] ABSTRACT

A combination hand tool for removing sheetrock screws or nails from sheetrock or similar structures and for forming a smooth spackle receiving cavity in place of the removed screw or nail. The tool includes a remover or puller portion for applying a force parallel to the longitudinal axis of the screw or nail during removal thereof and has a dimpler for smoothing the impression made by the screw or nail.

20 Claims, 5 Drawing Figures

COMBINATION FASTENER REMOVER AND DIMPLER

FIELD OF THE INVENTION

This invention relates to a combination hand tool for removing sheetrock screws or nails from sheetrock or similar structures and for forming a smooth spackle receiving cavity in place of the removed screw or nail. More particularly, the hand tool has a remover or puller portion for applying a force parallel to the longitudinal axis of the screw, or nail during removal thereof and has a dimpler for smoothing the impression made by the screw or nail.

DISCLOSURE INFORMATION STATEMENT

The inventor is and has been engaged in the residential/commercial hardware industry for the past twenty or so years. In reviewing catalogs of various manufacturers during this period, no combination tool of the nature disclosed herein has been uncovered. Because of the nature of the tool, no formal search of the Patent and Trademark Office records was conducted.

The need for the combination tool is apparent from the discussion which follows. In applying sheetrock panels or similar sheet or web-like materials to walls, the supporting beams are undetected or may be undetectable to the worker. In most work, beams are placed at regular intervals, such as 16-inch centers; however, at other times, such as with irregularly positioned walls, renovation of older structures, and uniquely shaped ceilings, the beams never seem to be where they ought to be. With improperly installed fasteners, sheetrock workers generally painstakingly, manually pick out the fasteners. Then, they drive the damaged surface below the plane of the sheetrock panel. The dimple formed in this manner often produces a surface requiring substantial spackling. If an ordinary claw hammer is used to remove the unsecured sheetrock screw or nail, the sheetrock covering is frequently ripped and pulled out of the screw/nailhole and is often likewise difficult to spackle.

The present invention provides a combination tool to resolve in a simple, labor saving manner the problems caused by such mis-hits.

SUMMARY OF THE INVENTION

The combination tool has a fastener puller having a thin pair of jaws which are constructed to slip readily under the side portions of the fastener head. The fastener puller further has a throat designed so that, upon full insertion, of the fastener head, the manual pulling force exerted through the use of the tool is parallel to the longitudinal axis of the fastener body. The clean removal of the fastener, with minimal disturbance of the surrounding panel is thereby facilitated. After removal of the fastener, the dimpler portion of the combination is next employed. The dimpler portion has a shaft follower, a cavity tamper, and an edge smoother. The spackle-receiving cavity is formed by the dimpler portion of the combination tool being inserted in the hole left by the removed fastener. The loose debris from the fastener insertion and removal is tamped in place. After bottoming the dimpler portion of the combination tool, the tool is rocked and rotated so as to smooth the edges of the spackle receiving cavity.

It is an object of the invention to provide a combination tool to facilitate installation of sheetrock and the like.

It is a further object of the invention to provide a tool which is easy to use and which improves the efficiency of the workman.

It is a yet further object of the invention to provide a tool in which a fastener removal device and a cavity forming device are conveniently provided in the same combination tool.

It is a feature of the invention that fastener removal forces are applied parallel to the longitudinal axis of the fastener.

It is a further feature of the combination tool that fasteners are removed from panels with minimal disturbance of the surface thereof.

It is a yet further feature of the invention that the cavity formed is small and smooth thereby facilitating repair prior to finishing of the installed panel.

Other objects and features of the invention will become apparent as the drawings which follow are understood by reading the corresponding description thereof.

DESCRIPTION OF PREFERRED EMBODIMENTS

Figure 1:
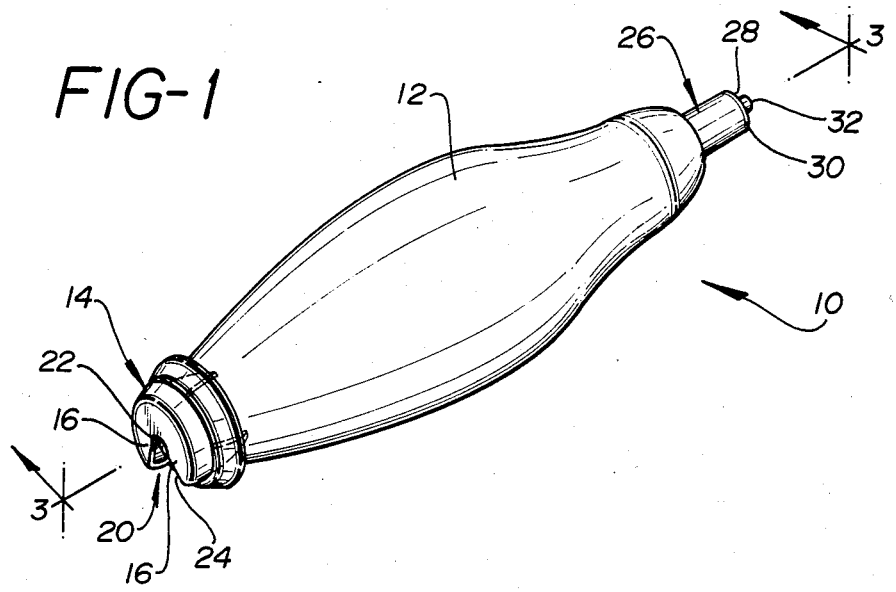
FIG. 1 is a perspective view of the combination tool of this invention.
Figure 2:
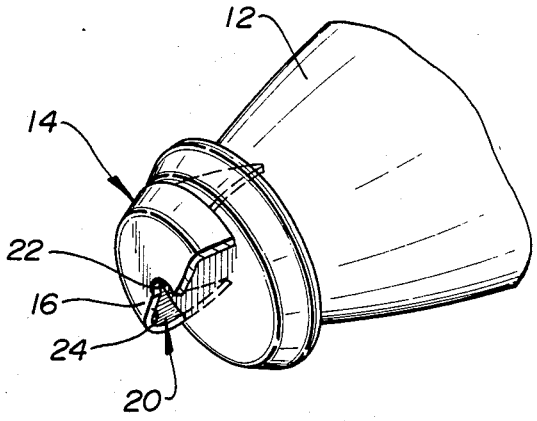
FIG. 2 is a partially cut-away detailed view of the fastener removal portion of the combination tool of this invention.

Referring now to the drawings in greater detail and more particularly to FIGS. 1 and 2 thereof, the reference numeral 10 represents a combination fastener remover and dimpler tool according to the present invention wherein there is a tool handle or elongated tool body 12, which handle can be made of virtually any common material but usually is constructed from wood or reinforced plastic. At one end of the tool 10 is a fastener remover 14 formed with a pair of space jaws 16. These jaws are substantially flat and lie within a plane normal to the longitudinal axis 18 of the tool body 12. Between the space jaws 16 the combination tool is structured to include a throat portion 20 for receiving the head of an improperly installed fastener. At the end of the throat portion opposite the receiving opening, there is a fastener stop 22 which aligns the fastener so that upon insertion of the fastener into the throat and against the stop, the longitudinal axis of the fastener and of the combination tool are substantially coaxial. The spaced jaws or V-guide 16 are constructed with thin or tapered facing edges 24 to facilitate handling of the improperly installed fasteners.

Figure 3:
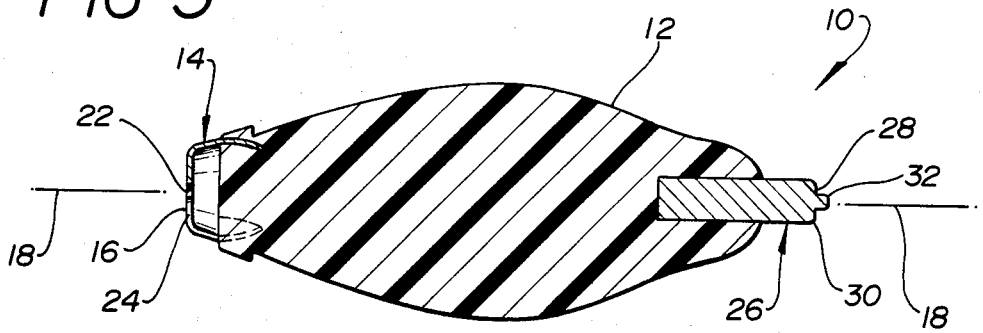
FIG. 3 is a cross-sectional view of the cavity forming portion of the combination tool of this invention.

Referring now to FIGS. 1 and 3 further details of the tamper portion of the tool are now described. The tamper 26 is for smoothing the cavity left by the removed fastener by rotatingly inserting the tool into the cavity and for smoothing the wall thereof. The dimpler 26 is attached to the tool body 12 at the end opposite the fastener remover 14. Although this dual functioning tool is shown with components mounted at 180 degrees apart on a elongated body, it is within the state of the art to mount additional tool functions on a combination tool such as a screwdriver head and awl, and to have these combined functions spaced at 90 degree intervals. The structure shown herewith is considered to be the best mode of the present invention. The dimpler 26 further includes a tamper portion 28 which is generally flat and normal to the longitudinal axis of the tool handle 12. This tamper portion 28 is for aggregating loosened particulate matter surrounding within the cavity left by the removed fastener. Adjacent the tamper portion 28 the dimpler 26 is structured to include a smoother portion 30 for, upon rotatingly applying the dimpler to the wall of the cavity, providing a shaped cavity of a predetermined profile. The dimpler 26 has extending forward from the tamper portion 28 a shaft follower portion 32 for positioning and centering the tool accurately within the cavity left by the removed fastener.

Figure 4:
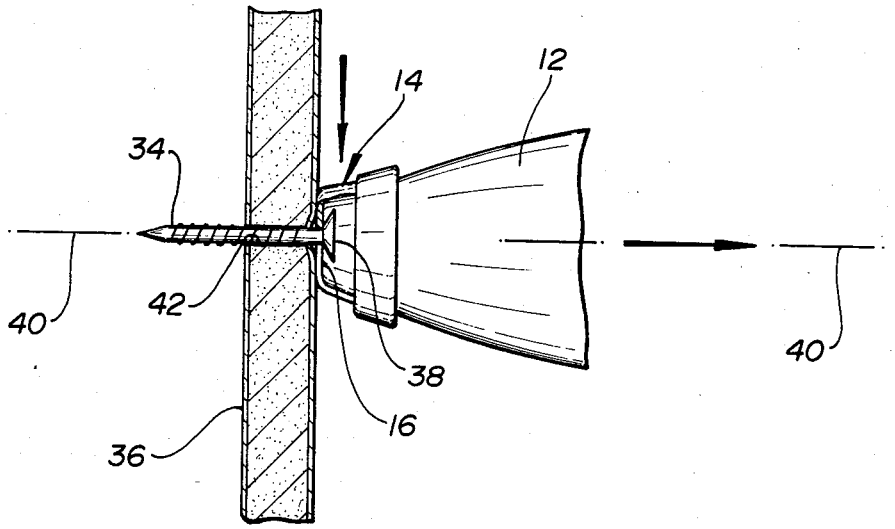
FIG. 4 is a detailed view showing the use of the tool during removal of a sheetrock fastener; and, FIG. 5 shows the tamping and smoothing action of the cavity forming portion of the combination tool of this invention.
Figure 5:
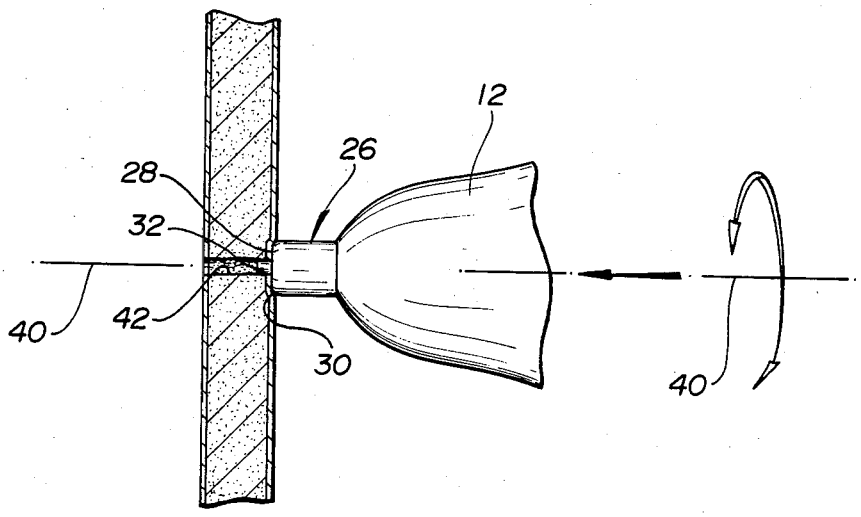

In operation, the use of the combination fastener remover dimpler and tool 10 is described with reference to FIGS. 4 and 5. The description is specific to sheetrock installation. In the course of sheetrock installation it is not uncommon to install improperly sheetrock screws by placing them in position within the sheetrock which is not backed by supporting members. Referring now specifically to FIG. 4 the sheetrock screw 34 is shown being removed from a sheetrock panel 36. The head 38 of the sheetrock screw is shown within space jaws 16 of fastener remover 14. The force required for removal of the sheetrock screw is shown exerted parallel to the longitudinal axis 40 of sheetrock screw 34. Upon removal a cavity 42 is formed. By exerting the removal force parallel to the shaft of the fastener, the damages to the surface of the sheetrock panel 36 are minimized, and as a result, far less repair is required. Additionally, a more and more aesthetic repair is feasible than with alternative methods. After removal of the sheetrock fastener the other end of the combination tool is now used as shown in FIG. 5. The shaft follower 32 guides the tool into position within the cavity 42 so that tamping and smoothing action provided by tamper portion 28 and smoother portion 30 may proceed with minimal enlargement of the cavity 42. In the tool shown as the best mode of the present invention, the smoother portion is curved in a slightly convex manner and provides a finished cavity of similar profile. While this is the preferred form, other profiles may be adopted.

While various changes may be made in the details of construction, it is understood that such changes will be within the spirit and scope of the present invention, as is defined by the appended claims.

What is claimed is:

1. A combination fastener remover and dimpler tool for removing an improperly installed fastener and forming in place thereof a smooth cavity, said combination tool comprising:

an elongated tool body having a medial portion forming a tool handle;

a pair of spaced jaws attached at one end of said elongated tool body, said jaws being substantially flat and lying within a plane substantially normal to the longitudinal axis of the tool handle;

a throat portion extending between said jaws for receiving the head of an improperly installed fastener; and, dimpler means for rotatingly inserting in the cavity left by a removed fastener and for smoothing the wall thereof, said dimpler means attached to said elongated tool body at the end opposite said spaced jaws;

whereby, upon improperly installing a fastener, the combination fastener and dimpler tool removes the fastener with a force exerted parallel to the shaft of the fastener, minimizing damage to the surface penetrated by the fastener, and smooths the cavity wall thereof.

2. A combination tool as described in claim 1, wherein said jaws further compromise:

stop means for stopping travel of said fastener head and aligning the fastener substantially coaxially with said tool handle, said stop means attached to the said jaws opposite said throat portion.

3. A combination tool as described in claim 1, wherein said dimpler means further comprises:

a tamper portion at the lower extremity thereof for compressing loose particulate matter in said cavity.

4. A combination tool as described in claim 3, wherein said dimpler means further comprises:

a smoother portion adjacent and rearward of the tamper portion for, upon rotatingly applying the dimpler means to the wall of said cavity, providing a shaped cavity of a predetermined profile.

5. A combination tool as described in claim 4, wherein said smoother portion is ellipsoidal and forms a curved-wall cavity.

6. A combination tool as described in claim 3, wherein said dimpler means further comprises:

shaft follower means extending forward from the tamper portion for centering the dimpler means in the cavity formed by the removed fastener.

7. A combination tool as described in claim 6, wherein said shaft follower is a cylindrical body having substantially the same diameter as the shaft of the fastener removed.

8. A combination fastener remover and dimpler tool for removing an improperly installed sheetrock fastener from the sheetrock panel being installed and forming in place of the removed sheetrock fastener a smooth cavity, said combination tool comprising:

an elongated tool body having a medial portion forming a tool handle;

a pair of spaced jaws attached at one end of said elongated tool body, said jaws being substantially flat and lying within a plane substantially normal to the longitudinal axis of the tool handle;

a throat portion extending between said jaws for receiving the head of an improperly installed sheetrock fastener; and, dimpler means for rotatingly inserting in the cavity left by a removed sheetrock fastener and for smoothing the wall thereof, said dimpler means attached to said elongated tool body at the end opposite said spaced jaws;

whereby, upon improperly installing a sheetrock fastener, the combination fastener and dimpler tool removes the fastener with a force exerted parallel to the shaft of the fastener while minimizing damage to the surface penetrated by the fastener, and smooths the cavity wall thereof.

9. A combination tool as described in claim 8, wherein said jaws further compromise:

stop means for stopping travel of said sheetrock fastener head and aligning the sheetrock fastener substantially coaxially with said tool handle, said stop means attached to the said jaws opposite said throat portion.

10. A combination tool as described in claim 8, wherein said dimpler means further comprises:

a tamper portion at the lower extremity thereof for compressing loose particulate matter in said cavity.

11. A combination tool as described in claim 10, wherein said dimpler means further comprises:

a smoother portion adjacent and rearward of the tamper portion for, upon rotatingly applying the dimpler means to the wall of said cavity, providing a shaped cavity of a predetermined profile.

12. A combination tool as described in claim 11, wherein said smoother portion is illipsoidal and forms a curved-wall cavity.

13. A combination tool as described in claim 10, wherein said dimpler means further comprises:

shaft follower means extending forward from the tamper portion for centering the dimpler means in the cavity formed by the removed fastener.

14. A combination tool as described in claim 13, wherein said shaft follower is a cylinderical body having substantially the same diameter as the shaft of the fastener removed.

15. A combination fastener remover and dimpler tool for removing an improperly installed fastener and forming in place thereof a smooth cavity, said combination tool comprising:

an elongated tool body having a medial portion forming a tool handle;

remover means for removing an improperly installed fastener said remover means attached at one end of said elongated tool body and disposed to apply removal forces parallel to the longitudinal axis of the fastener;

dimpler means for rotatingly inserting in the cavity left by a removed fastener and for smoothing the wall thereof, said dimpler means attached to said elongated tool body at the end opposite said remover means, said dimpler means in turn, further comprising:

a tamper portion at the lower extremity thereof for loose particulate matter in said cavity;

a smoother portion adjacent and rearward of the tamper portion for, upon rotatingly applying the dimpler means to the wall of said cavity, providing a shaped cavity of a predetermined profile; and shaft follower means extending forward from the tamper portion for centering the dimpler means in the cavity formed by the removed fastener, whereby, upon improperly installing a fastener, the combination fastener and dimpler tool removes the fastener with a force exerted parallel to the shaft of the fastener, minimizes damage to the surface penetrated by the fastener, and smooths the cavity wall thereof.

16. A combination tool as described in claim 15 wherein said remover means further comprises:

a pair of spaced jaws attached at one end of said longated tool body, said jaws being substantially flat and lying within a plane substantially normal to the longitudinal axis of the tool handle,

17. A combination tool as described in claim 16 wherein said remover means further comprises:

a throat portion extending between said jaws for receiving the head of an improperly installed fastener,

18. A combination tool as described in claim 17, wherein said jaws further comprise:

stop means for stopping travel of said fastener head and aligning the fastener substantially coaxially with said tool handle, said stop means attached to the said jaws opposite said throat portion.

19. A combination tool as described in claim 15, wherein said smoother portion is ellipsoidal and forms a curved-wall cavity.

20. A combination tool as described in claim 15, wherein said shaft follower is a cylindrical body having substantially the same diameter as the shaft of the fastener removed.

* * * * *